US007528794B2

(12) United States Patent
Zurowski et al.

(10) Patent No.: US 7,528,794 B2
(45) Date of Patent: May 5, 2009

(54) INSTALLATION ASSEMBLY FOR A MOTOR VEHICLE ANTENNA

(75) Inventors: Miroslaw J Zurowski, Cracow (PL); Frank Hofmann, Solingen (DE); Robert Toellner, Bad Salzdetfurth (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/977,105

(22) Filed: Oct. 23, 2007

(65) Prior Publication Data

US 2008/0129620 A1 Jun. 5, 2008

(30) Foreign Application Priority Data

Nov. 3, 2006 (EP) ..... 06022960

(51) Int. Cl.
*H01Q 1/12* (2006.01)

(52) U.S. Cl. ..... 343/891; 343/878

(58) Field of Classification Search ..... 343/878, 343/880, 890, 891
See application file for complete search history.

(56) References Cited

U.S. PATENT DOCUMENTS

| | | | | |
|---|---|---|---|---|
| 6,307,516 | B1 | 10/2001 | Zafar et al. | |
| 6,509,878 | B1 * | 1/2003 | Tornatta et al. | 343/715 |
| 6,714,164 | B2 * | 3/2004 | Shimizu | 343/715 |
| 6,861,991 | B2 | 3/2005 | Mueller et al. | |
| 6,930,643 | B2 | 8/2005 | Byrne et al. | |
| 7,129,895 | B2 | 10/2006 | Morris et al. | |
| 7,245,261 | B2 | 7/2007 | Zafar et al. | |
| 2003/0231140 | A1 | 12/2003 | Haussler et al. | |
| 2004/0183734 | A1 | 9/2004 | Noro | |

FOREIGN PATENT DOCUMENTS

| | | |
|---|---|---|
| DE | 9102092 | 5/1991 |
| DE | 20 2005 004 658 | 6/2005 |
| DE | 10 2004 037 813 | 10/2005 |
| EP | 1 120 853 | 6/2005 |
| JP | 10 178311 | 6/1998 |
| JP | 2006 157859 | 6/2006 |

OTHER PUBLICATIONS

European Search Report dated Mar. 15, 2007.

* cited by examiner

*Primary Examiner*—Don P Le
(74) *Attorney, Agent, or Firm*—Jimmy L Funke

(57) ABSTRACT

The present invention relates to an installation assembly with which a motor vehicle antenna can be fastened to the body of a motor vehicle without an additional tool. The installation assembly includes a base plate from which at least one fastening section to be introduced through an opening of the body into the interior thereof projects. Furthermore, the installation assembly includes a latch body which is to be arranged in the interior of the body, which cooperates with the fastening section and which has a support section which is spaced apart from the base plate by a clear spacing.

14 Claims, 6 Drawing Sheets

Fig.2.
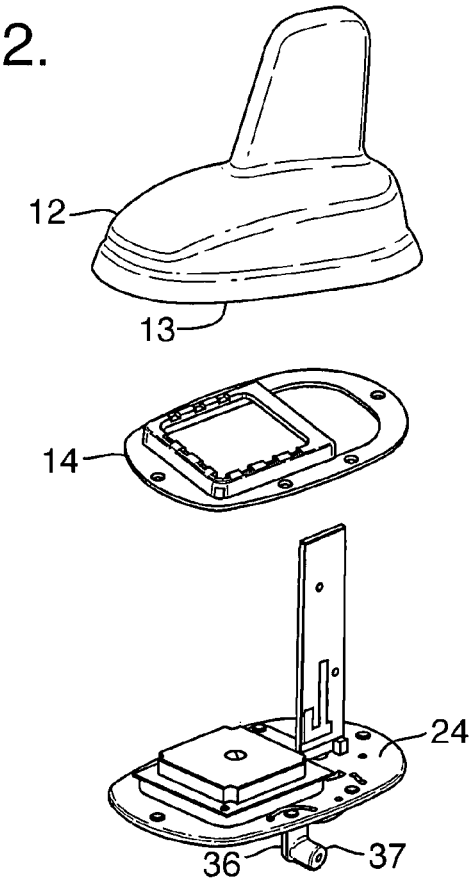
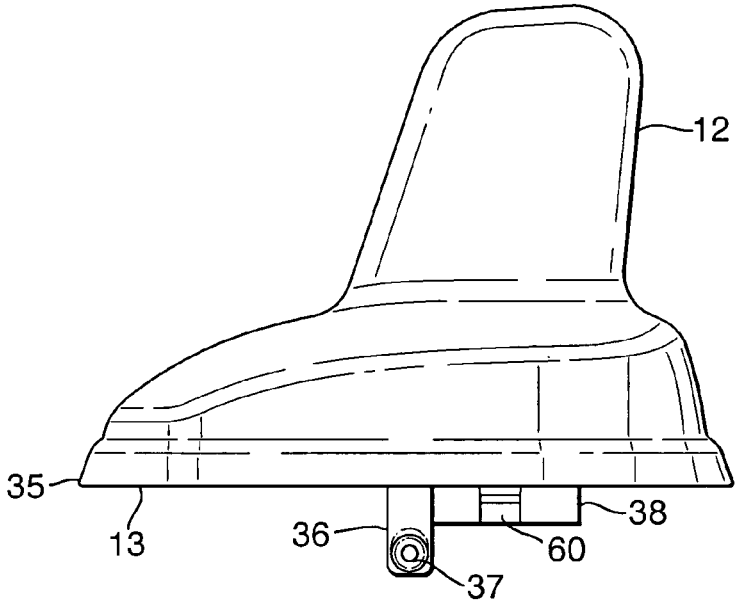
Fig.2a.

Fig.5.
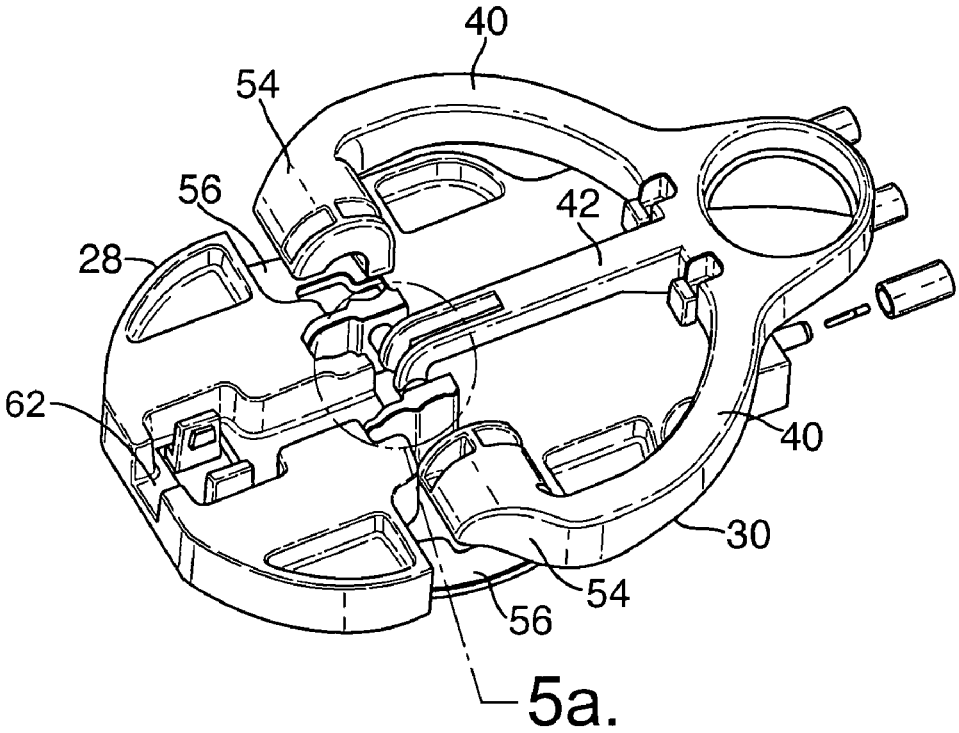
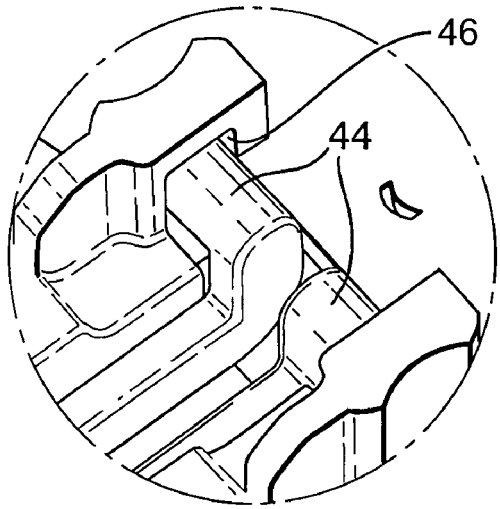
Fig.5a.

INSTALLATION ASSEMBLY FOR A MOTOR VEHICLE ANTENNA

TECHNICAL FIELD

The present invention relates to an installation assembly with which a motor vehicle antenna can be fastened to the body of a motor vehicle.

BACKGROUND OF THE INVENTION

Generally, two different fastening possibilities are known for the external attachment of a motor vehicle antenna to the body of a motor vehicle. On the one hand, the possibility exists of screwing the antenna firmly to the body; on the other hand, the antenna can be adhesively bonded to the body.

In the screwed variant, an antenna base is attached to the body at the outer side, with the antenna base extending with a screw stub through a body opening into the interior of the body, with a nut being screwed onto said screw stub for the fastening and clamping to the body, as is described, for example, in EP 1 120 853 B1.

The screwed variant, however, proves to be disadvantageous to the extent that an additional tool, for example a wrench, is required to screw the nut onto the screw stub. Furthermore, the installation is difficult in the screwed variant since the antenna stub first has to be loosely arranged on the body at the outer side before an installing person can counter-screw the said nut from the inside so that there is the risk that the antenna base is displaced in the meantime so that frequently two installing persons are required for the installation of such screwed antenna bases of whom one holds the antenna base and the other carries out the screw fastening. Furthermore, in the screwed variant, the antenna cables project in a directly perpendicular manner into the inner space of the body so that they have to be bent for laying, whereby cable breakage can occur.

In the adhesively bonded variant, the antenna base is, in contrast, only firmly bonded to the body so that special adhesives have to be used to be able to ensure a permanent resistance of the adhesive bond, whereby comparatively high costs are caused in an unwanted manner. Furthermore, problems occur in the adhesively bonded variant with respect to the servicing of the antenna components which are only accessible by destroying the adhesive bond.

SUMMARY OF THE INVENTION

Starting from the problems described above which the known fastening variants suffer from, the object of the present invention is to provide an installation assembly for the fastening of a vehicle antenna to the body of a motor vehicle which overcomes at least some of the problems shown.

This object is satisfied by an installation assembly having the features of claim 1. The object is in particular satisfied in that the fastening section projecting from the base plate has a support section which is spaced apart from the base plate by a clear distance and in that the latch body has a latch section which can be wedged between the base plate and the body at the said spacing such that the base plate is tensioned with respect to the body. The latch section can, for example, include a ramp section or wedge section which is pushed into the said space with its tapering side to the front and which is thus supported at the support section, on the one hand, and at the inner side of the body, on the other hand, on a deeper penetration into the clear spacing, whereby the fastening section is drawn deeper into the interior of the body via the support section such that the base plate of the installation assembly is clamped to the body.

No additional tools are required due to the wedge effect of the latch section on the installation of the installation assembly since the latch section can be introduced into the clear spacing between the base plate and the body by hand. The smaller the inclination of the ramp section, the less force is needed to wedge the ramp section in the said spacing so that the assembly can be carried out with only a small expenditure of force.

Furthermore, in contrast to the known adhesively bonded variant, no expensive adhesives are required which can become brittle over time so that the problems with respect to the permanence of the known bonded variant with the installation assembly in accordance with the invention can also be overcome.

Ultimately, the installation assembly in accordance with the invention can also be dismantled easily again by removal of the latch section so that it is not necessary to destroy parts of the installation assembly for servicing purposes.

Advantageous further developments of the assembly installation in accordance with the invention result from the dependent claims, from the description and from the drawings.

To also be able to have the installation of the assembly installation in accordance with the invention carried out by untrained personnel, it is desirable to standardize the installation procedure to a very large extent in order to be able to preclude any error sources in the installation. Accordingly, the installation assembly can include an adapter plate to be arranged in the interior of the body which can have at least one first electrical connection which can be connected to at least one mating electrical connection projecting from the base plate into the interior of the body. In this connection, in particular the latch body of the installation assembly can be movably supported at the adapter plate such that it can be repeatedly wedged in the spacing, guided on an identical movement path.

If the adapter plate has a (first) electrical connection for coupling to the mating electrical connection at the base plate, the relative position of the latch section located at the latch body with respect to the fastening section or its support section is precisely defined by the coupling of the first electrical connection to the associated mating connection so that no errors can occur during the installation with respect to the positioning of the at least one latch section with respect to the associated fastening section. This can in particular prove to be advantageous when latch bodies having latch sections shaped differently from one another are used since an unintentional swapping of the different latch sections can thus be avoided.

The reproducibility of the installation can furthermore in particular be improved by the movable support of the latch body at the adapter plate since hereby an incorrect installation, such as a canting of the ramp-shape latch section, can be precluded.

To avoid the initially described risk of cable breakage such as can occur with the screwed installation variant, the adapter plate can have at least one second electrical connection which branches off from the adapter plate in the plane thereof. Each of these (second) connections can, for example, be connected via a conductor plate to an associated first electrical connection of the adapter plate, with said connection being able to be coupled to the base plate so that a rigid connection is present between the first and second electrical connections which, unlike the bent cable in the screwed variant, is not subject to any movements, which could otherwise result in cable breakage over time.

In accordance with a further aspect of the invention, the latch body can be pivotably supported at the adapter plate via a joint. As will be explained further below, a lever effect can be achieved via this joint with whose aid the latch section can be wedged in the clear spacing between the support section and the body with only low force expenditure.

So that the latch section can be introduced into the clear spacing due to the pivot movement of the latch body without the occurrence of any jamming and can be wedged therein, the latch section of the latch body can form a pivot wedge with a receiver for the support section of the fastening section. The latch section can thus, for example, have a concavely and convexly curved wedge shape, with a design being understood by this which tapers regionally and which is curved per se such that one of the two mutually oppositely disposed wedge surfaces has a concave curvature as a receiver for the support section, whereas the other wedge surface has a convex curvature as a slide surface. The latch section can be introduced easily into the spacing between the support section and the body by such a shape as a result of the pivot movement of the latch body without jamming occurring.

The inward pivoting of the latch section into the clear spacing between the support section and the body can in particular be achieved in that the latch section is arranged on the pivot axis of the joint so that the latch section is not pivoted around its own axis during the pivot movement of the latch body.

To be able to generate the lever effect already previously addressed, the latch body can have an actuation lever by whose actuation the latch section undergoes a torque. It is thus not necessary to apply a correspondingly large torque directly to the latch body or to its latch section; this torque can rather be generated in that only a small force is applied to the actuation lever so that a correspondingly increased torque can be achieved multiplied by the lever arm or its length.

To be able to (releasably) fix the base plate of the installation assembly in accordance with the invention to the body temporarily during the installation at least for the avoidance of any slipping, the base plate can have at least one spring element. At least one spring element which protrudes into the interior of the body can in particular project from the base plate and have a design such that it can be releasably latched in an opening of the body. The base plate can be releasably fixed in contact with the outer side of the body in this manner such that no second installation person is necessary to prevent a slipping of the base plate during the installation. The spring element can, for example, be a barb-like notch which initially deforms slightly on the introduction into the opening of the body in order subsequently to latch releasably at the contour of the body opening. In this manner, a simple dismantling can also be ensured in the servicing case without an additional tool being necessary.

For the protection of the mating electrical connection, the base plate can have a tube-shaped connection stub which projects therefrom and in whose interior the mating connections of the base plate are located so that damaging effects can be avoided to a very large extent. Furthermore, the connection support can also serve as a guide which cooperates with a corresponding mating piece at the adapter plate in order to be able to guide them together in the manner of a plug connection.

Since an element projecting into the interior of the body is already present by the support stub, the already previously mentioned spring element can be present at the support stub. Apart from this, it is, however, likewise possible to form the spring element at the fastening sections projecting into the interior of the body. Weight, on the one hand, and costs, on the other hand, can be saved by such an integral forming of the spring elements due to the lower material effort.

Since the latch section can be wedged in the clear spacing, it can be desirable to limit the friction occurring on the introduction into the clear spacing to a specific amount. It can likewise be desirable for the latch section not to come directly into contact with the inner side of the body in order to avoid scratching of the body. Accordingly, the adapter plate can include at least one slide section which is arranged such that the convex slide surface of the latch section can slide along the base plate on the clamping thereof. To reduce the friction as much as possible, the slide section can, for example, be made of a material, or at least be coated therewith, which only has a very low friction coefficient, such as is the case with Teflon® (PTFE).

Since modern motor vehicle antennas usually include a plurality of transmission and/or reception antennas, including the associated electronic components, which can be received by the base plate, there is a need to equip the base plate before the actual installation of the installation assembly at the body in order subsequently to be able to mount the fully equipped base plate as a whole. Since the named transmission and/or reception antennas as well as the associated electronic components are, however, sensitive both to weather influences and to mechanical strains during the transport and the assembly, the installation assembly can furthermore have a housing cap serving for the housing of the electronic components of the antenna and releasably connected to the base plate. The total unit of base plate and the housing cap associated therewith can thereby be attached as a whole to the body during the installation of the installation assembly so that the assembly can be accelerated.

For the reception of the base plate, the housing cap can have an opening for the reception of the base plate which is matched to the shape of the base plate such that the inner space of the housing cap is outwardly closed by the base plate.

In accordance with a further aspect of the invention, the housing cap can be provided with a rubber covering which forms a sealing lip projecting over the opening of the housing cap. This sealing lip comes into contact with the outer side of the body on the installation of the base plate or of the unit of base plate and housing cap and thus seals the inner space of the housing cap with respect to the outside atmosphere so that no moisture can penetrate into the inner space of the housing cap.

BRIEF DESCRIPTION OF THE INVENTION

The present invention will be explained in more detail in the following with reference to an exemplary embodiment and to the enclosed Figures. Elements which are the same or which correspond to one another are marked by the same reference numerals in all Figures, with:

FIG. 2 illustrates the assembly of the unit of base plate and housing cap;

Figure 3:
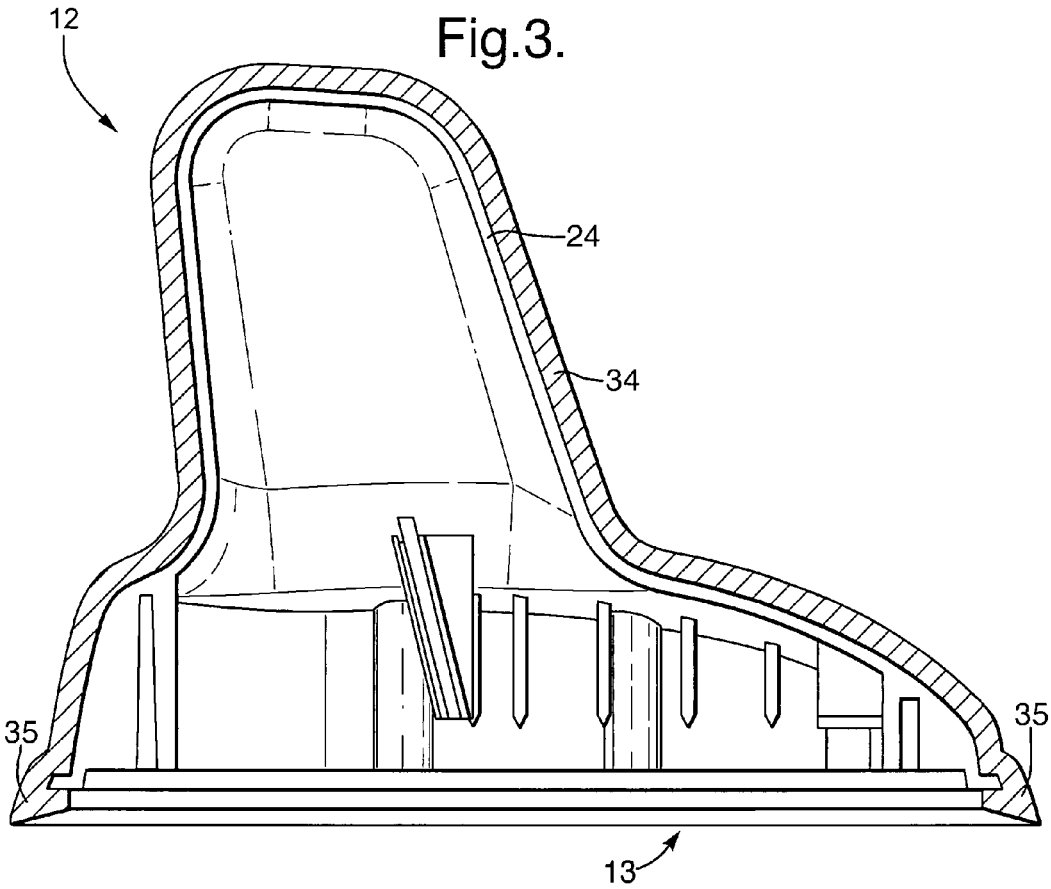
Figure 4:
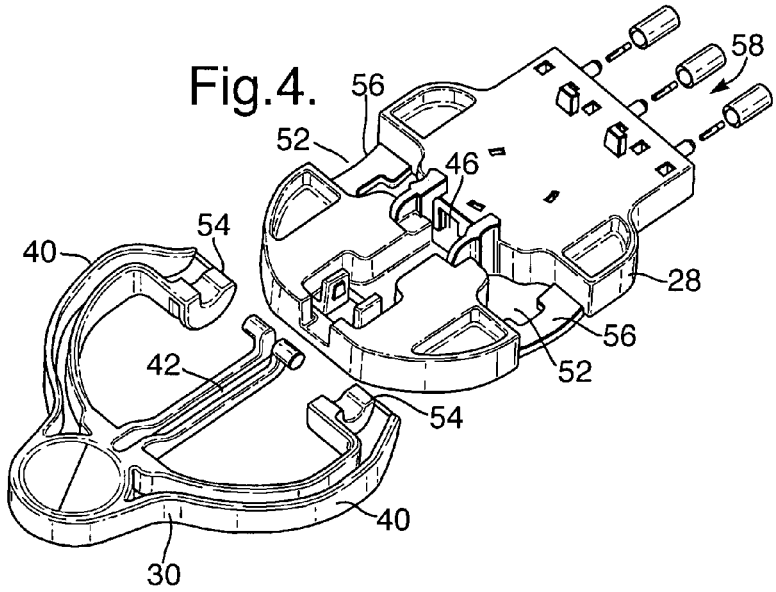
Figure 6:
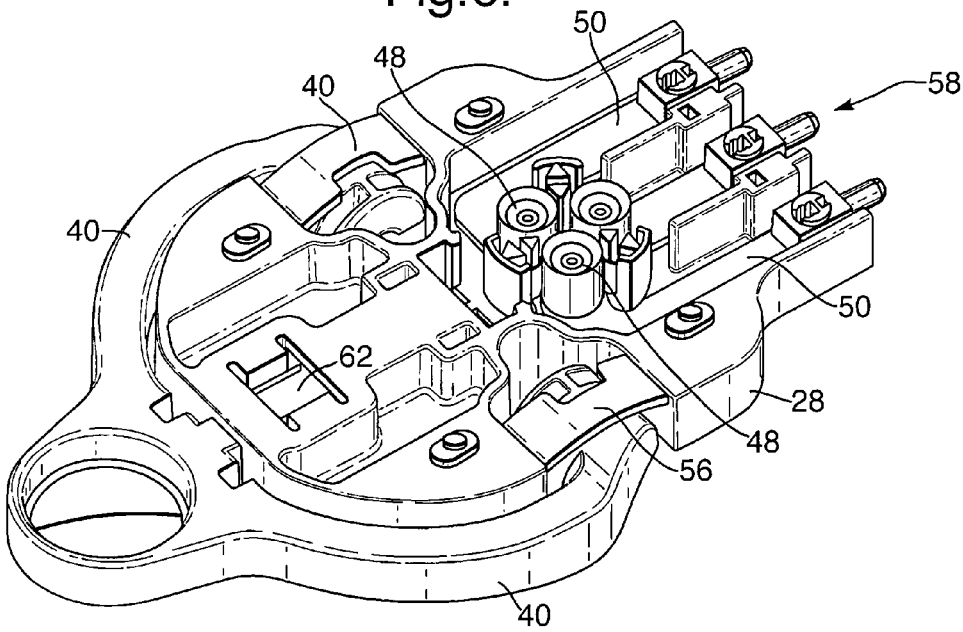
Figure 7:
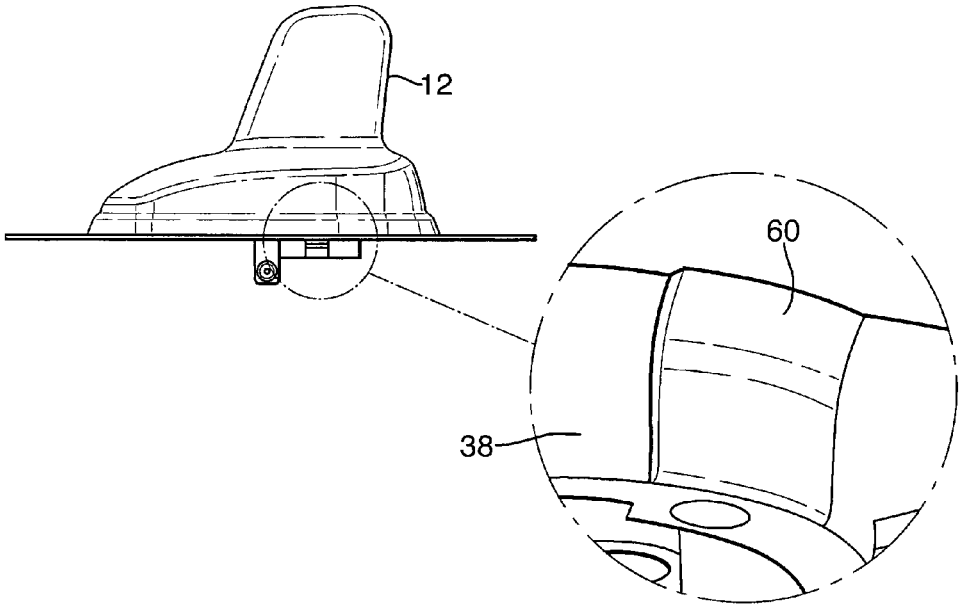
Figure 8:
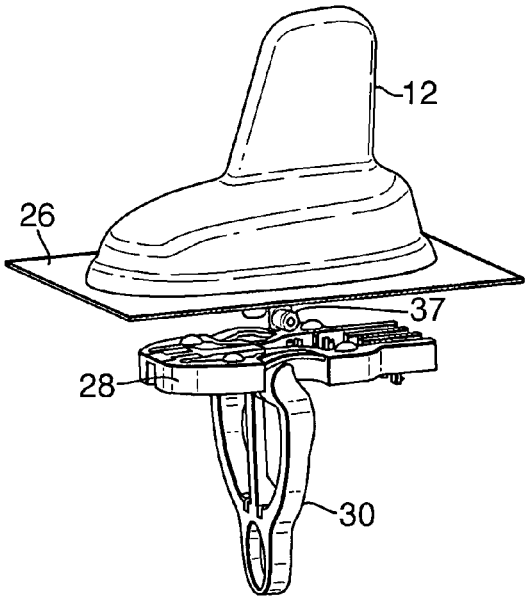
Figure 9:
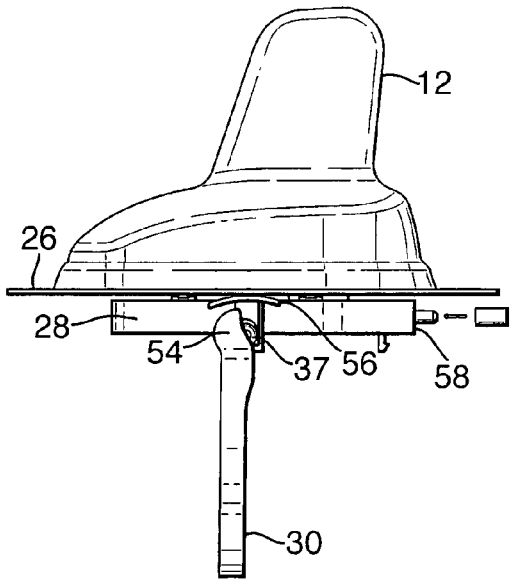
Figure 10:
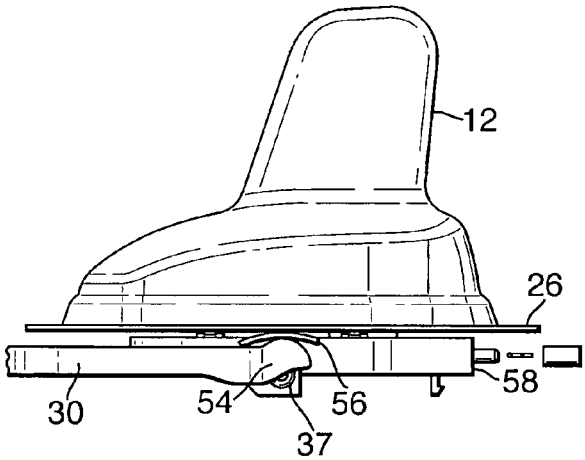

FIG. 2*a* is a plan view of the assembled base plate and housing cap;

FIG. 3 is a section through the housing cap;

FIG. 4 is a perspective lower view of the adapter plate and of the latch body;

FIG. 5 is a perspective lower view of the unit of adapter plate and latch body including a detail;

FIG. 6 is a perspective top view of the unit of adapter plate and latch body;

FIG. 7 is an enlarged representation of a spring element projecting from the base plate; and FIGS. 8 to 10 illustrate the installation of the installation assembly in accordance with the invention.

DESCRIPTION OF THE PREFERRED EMBODIMENT

Figure 1:
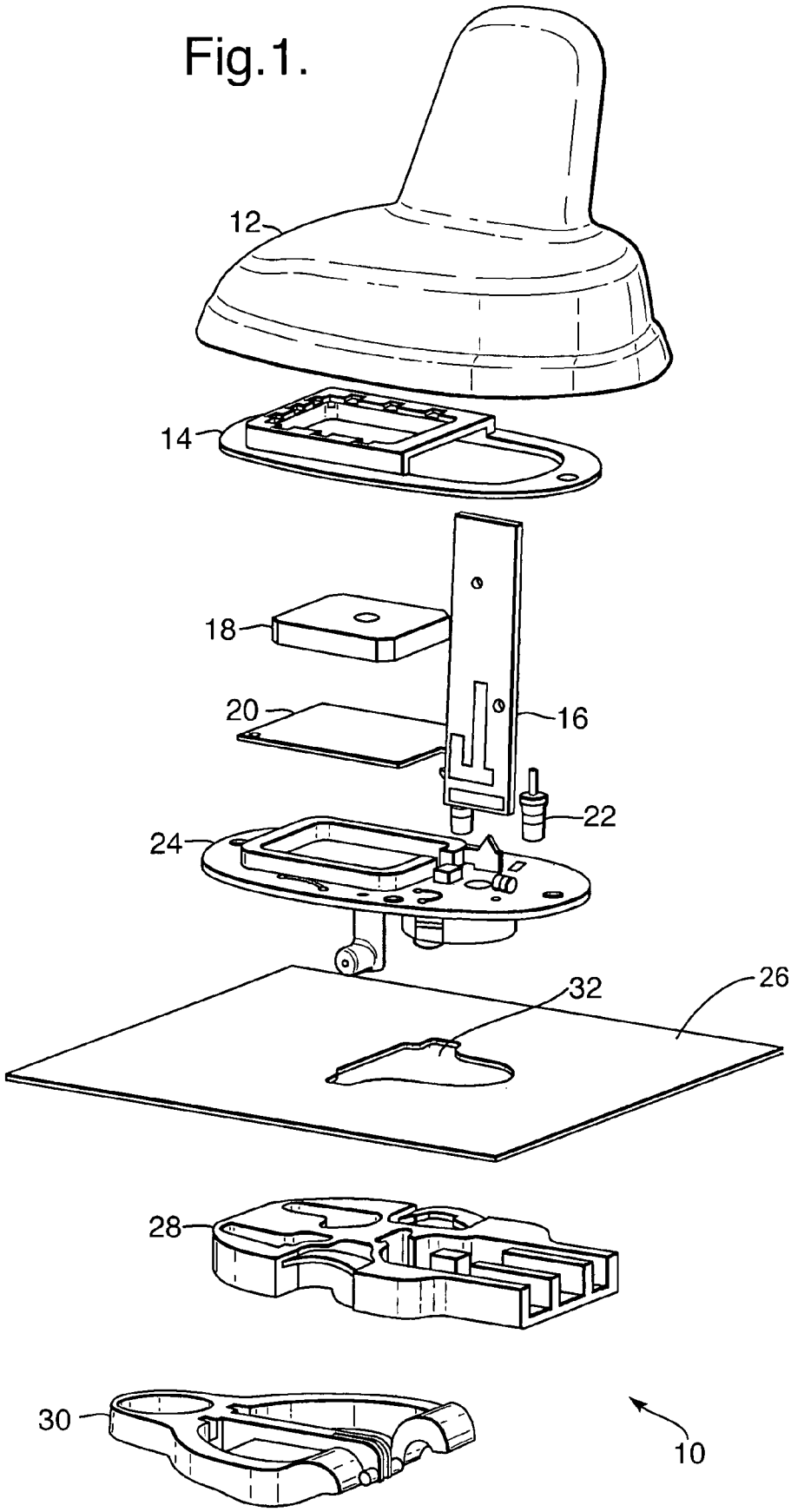
FIG. 1 is an exploded representation of the installation assembly in accordance with the invention.

The individual components of the installation assembly 10 as well as of the electronic components received thereby will be presented with reference to FIG. 1. The installation assembly 10 has a base plate 24 which comes into contact with the body 26 at the outer side. The installation assembly 10 furthermore has a latch body 30 which is located at the interior of the body 26 and serves to clamp the base plate 24 to the body 26. An adapter plate 28 is likewise arranged in the interior of the body 26 and the latch body 30 is pivotably supported thereon via a joint such as a hinge connection (see in particular FIGS. 4 and 5).

Furthermore, the installation assembly 10 includes a housing cap 12 in whose inner space the electronic components 16 to 22 to be received by the base plate 24 come to lie. These electronic components 16 to 22 can, for example, be a mobile radio antenna 16, a GPS electronic component 18, a circuit board 20 as well as electronic SMD components 22 directly soldered onto the circuit board 20. The housing cap 12 has an opening 13 at the lower side in order to be able to receive the base plate 24 therein. An inner seal 14 is arranged between the base plate 24 and the opening 13 of the housing cap 12 in order to avoid any entry of moisture into the inner space of the housing cap 12.

As can be seen from the sectional representation of FIG. 3, the actual housing cap 24 is provided with a rubber covering 34 which forms a peripheral sealing lip 35 projecting beyond the opening 13 of the housing cap 12. The housing cap 12 contacts the body 26 with the base plate 24 received in it by means of the sealing lip 35 so that a second sealing barrier is provided by the sealing lip 35 in addition to the inner seal 14.

To ensure a fast installation of the installation assembly 10 to the body 26, the unit of housing cap 12 and base plate 24 together with the electronic components 16 to 22 received thereby can be assembled in a preceding installation step, as is explained by FIGS. 2 and 2*a*. In this connection, the electronic components 16 to 22 are first installed on the base plate 24 so that the latter can subsequently be introduced together with the inner seal 14 into the opening 13 of the housing cap 12 in order subsequently to be screwed thereto. This state is illustrated in FIG. 2.

As can best be seen from FIGS. 1, 2, and 2*a*, two fastening sections 36 project from the lower side of the base plate 24, with only one of the two, however, being able to be recognized in FIGS. 1 and 2 due to the perspective representation. Cylindrical support sections 37 which are spaced apart by a clear spacing with respect to the lower side of the base plate 24 project at their free distal ends from the fastening sections 36. The support sections 37 serve to cooperate with the already mentioned latch sections so that the base plate 24 is clamped against the body 26. For this purpose, the fastening sections 36 project through an opening 32 in the body 26 into the interior thereof in order there to be acted on by the latch body 30 with a tensile force into the interior of the body 26.

Next to the fastening sections 36, a tube-shaped connection stub 38 projects from the lower side of the base plate 24 and likewise projects through the opening 32 into the interior of the body 26. The connection stub 38 receives electrical connection pins, not shown in more detail in the Figures, which serve for the connection of the electronic components 16 to 22 to a receiver in the interior of the body 26.

The unit of adapter plate 28 and latch body 30 will be explained in more detail in the following with reference to FIGS. 4 to 6. As can be seen from FIG. 4, the latch body 30 has a substantially E-shaped form with two outer arms 40 and one inner arm 42. The inner arm 42 is provided at its free distal end with two hinge or joint spigots 44 with the help of which the latch body 30 can be pivotally connected to the adapter plate 28. The joint spigots 44 thus define a pivot axis around which the latch body 30 can be pivoted with respect to the adapter plate 28 as can best be seen from the illustrations of FIGS. 8 to 10.

The latch body 30 is equipped at the free distal ends of the outer arms 40 with pivot wedges in the form of concavely and convexly curved latch sections 54 which are located in an extension of the joint pivots 44 on the pivot axis defined by them. For the fastening of the latch body 30 to the adapter plate 28, the latter has corresponding hinge openings 46 (FIG. 4) into which the joint spigots 44 engage, as is shown by FIG. 5 and in particular by the detail A of FIG. 5.

At the upper side, the adapter plate 28 has three electrical connection sockets 48 (FIG. 6) to establish an electrical connection with the connection pins already previously addressed (not shown) which project from the base plate 24 into the interior of the body 26. Three strip-shaped conductor plates 50 extend outwardly from the connection sockets 48 in the plane of the adapter plate 28 up to its marginal region, where they branch off from the plane of the adapter plate 28 in the form of three connections 58 in the plane of the adapter plate 28. In this manner, the connection cables can be laid between a receiver and the antenna without having to be bent in the process.

In an extension of the joint spigots 44 (FIG. 5), where the latch sections 54 are located, the adapter plate 28 has corresponding recesses 52 which are, however, bridged on the upper side of the adapter plate 28 by slide sections 56 at which the convex outer contours of the latch sections 54 can slide along during a pivoting of the latch body 30.

In the following, the installation and operation of the installation assembly 10 in accordance with the invention on a body 26 will be explained with reference to FIGS. 7 to 10. First, it is started to bring the prefabricated unit of housing cap 12 and base plate 24 into contact with the outer side of the body 26 so that the sealing lip 35 seals the inner space of the housing cap 12 with respect to the external atmosphere. As a consequence of the attachment of the unit of housing cap 12 and base plate 24 to the body 26, both the connection stub 38 and the two fastening sections 36 extend into the interior of the body 26. For the positional security of the unit 12, 24 during the installation on the body 26, the connection stub 38 has a plurality of spring elements 60 at the peripheral side which project into the interior of the body and which latch at the contour of the opening 32 as a consequence of the introduction of the connection stub 38 into the opening 32 of the body 26 so that an unwanted positional change of the unit of housing cap 12 and base plate 24 during the installation can be precluded.

After the unit of housing cap 12 and base plate 24 has been secured to the body 26 in the manner just described, the adapter plate 28 together with the latch body 30 pivotably supported thereon in the interior of the body 26 can subsequently be connected to the unit 12, 24 located outside the body 26, for which purpose the adapter plate 28 together with the latch body 30 hinged thereto is guided from below to the unit of housing cap 12 and base plate 24 so that first an electrical connection is established between the connector pins which are not recognizable here and which project from the base plate 24 into the interior of the body 26 and the connector sockets 48 of the adapter plate 28. The relative position of the adapter plate 28 with respect to the base plate 24 is first secured thereby, as FIG. 9 shows.

Subsequently, only the latch body 30 is pivoted around approximately 90°, as is shown by the transition from FIG. 9 to FIG. 10, whereby the concavely/convexly curved latch sections 54, considered from the inner space of the body, engage behind the support sections 37 and receive them to wedge themselves in the clear spacing between the support sections 37 and the body 26. In this connection, the convex slide surface of the latch sections 54 slide along the slide sections 56 of the adapter plate 28, whereby a scratching of the body 26 is avoided.

To permanently secure the position of the latch body 30 pivoted by approximately 90°, a latch element 62 can be provided at the adapter plate 28 and/or at the latch body 30 itself (FIG. 6) via which the latch body 30 can be brought into engagement with the adapter plate 28 in the position pivoted by 90°.

Due to the wedging of the latch section 54, a tensile force is introduced via the support sections 37 into the associated fastening sections 36, said tensile force resulting in the base plate 24 together with the housing cap 12 fastened thereto being clamped against the body 26, so that the installation of the installation assembly 10 is concluded.

As becomes obvious from the above explanations, the total installation of the installation assembly 10 to the body 26 can be carried out without an additional tool. Furthermore, the installation assembly 10 can be dismantled just as easily again for servicing purposes without having to destroy any components of the installation assembly 10.

The invention claimed is:

1. An installation assembly (10) for fastening a vehicle antenna to the body of a motor vehicle comprising:

a base plate configured for contact to the outer side of the body and for the reception of at least one electronic component of the antenna and from which at least one fastening section projects which is to be introduced through an opening of the body into the interior thereof; and a latch body arranged in the interior of the body and cooperating with the fastening section, wherein fastening section has a support section which is spaced apart from the base plate by a clear spacing; and in that the latch body has a latch section which can be wedged in the spacing such that the base plate is clamped against the body.

2. The installation assembly of claim 1, wherein the installation assembly has an adapter plate arranged in the interior of the body and at which the latch body is movably supported.

3. The installation assembly of claim 2, wherein the adapter plate has at least one first electrical connection which can be connected to at least one mating electrical connection projecting from the base plate into the interior of the body.

4. The installation assembly of claim 2, wherein the adapter plate has at least one second electrical connection which branches off the adapter plate in the plane thereof.

5. The installation assembly of claim 2, wherein the latch body is pivotably supported at the adapter plate via a joint.

6. The installation assembly of claim 1, wherein the latch section of the latch body forms a pivot part having a receiver for the support section of the fastening section.

7. The installation assembly of claim 5, wherein the latch section is arranged on the pivot axis of the joint.

8. The installation assembly of claim 5, wherein the latch body has an actuation lever by whose actuation the latch section undergoes a torque.

9. The installation assembly of claim 1, wherein at least one spring element, with which the base plate can be fixed to the body, is provided at the base plate.

10. The installation assembly of claim 2, wherein a connection stub which receives the at least one mating connection is provided at the base plate and projects therefrom.

11. The installation assembly of claim 10, wherein the spring element is provided at the connection stub.

12. The installation assembly of claim 2, wherein the adapter plate includes at least one slide section which is arranged such that the latch section slides along it on the clamping of the base plate.

13. The installation assembly of claim 1, further comprising a housing cap which serves for the housing of the electronic components of the antenna and has an opening configured for the receiving of the base plate such that it outwardly tightly closes the inner space of the housing cap.

14. The installation assembly of claim 13, wherein the housing cap is provided with a covering of an elastic material which forms a sealing lip projecting beyond the opening of the housing cap.

* * * * *